US008950752B2

(12) United States Patent
Gette et al.

(10) Patent No.: US 8,950,752 B2
(45) Date of Patent: Feb. 10, 2015

(54) WICKER-TYPE FACE SEAL AND WELLHEAD SYSTEM INCORPORATING SAME

(75) Inventors: Nicholas Peter Gette, Houston, TX (US); Armando Faz, Katy, TX (US); Stephen Ellis, The Woodlands, TX (US)

(73) Assignee: Vetco Gray Inc., Houston, TX (US)

( * ) Notice: Subject to any disclaimer, the term of this patent is extended or adjusted under 35 U.S.C. 154(b) by 925 days.

(21) Appl. No.: 12/826,443

(22) Filed: Jun. 29, 2010

(65) Prior Publication Data

US 2011/0316236 A1 Dec. 29, 2011

(51) Int. Cl.

| | |
|---|---|
| ***E21B 33/00*** | (2006.01) |
| ***E21B 33/10*** | (2006.01) |
| ***F16J 15/02*** | (2006.01) |
| ***E21B 33/03*** | (2006.01) |
| ***E21B 33/04*** | (2006.01) |

(52) U.S. Cl.

CPC ..... *E21B 33/03* (2013.01); *E21B 33/0422* (2013.01)

USPC ..... 277/323; 166/85.3; 166/382; 277/608; 277/337; 277/322; 277/312

(58) Field of Classification Search

USPC ..... 277/338–341, 608, 609, 312, 322, 323; 166/85.3, 88.3, 86.1, 382, 89.3, 208; 285/332.2, 332, 3

See application file for complete search history.

(56) References Cited

U.S. PATENT DOCUMENTS

| | | | | |
|---|---|---|---|---|
| 1,834,581 | A * | 12/1931 | Ferrell et al. | 285/328 |
| 1,906,826 | A * | 5/1933 | Smith et al. | 285/331 |
| 2,269,486 | A * | 1/1942 | Santoro | 277/612 |
| 3,127,198 | A * | 3/1964 | Orund | 285/123.6 |
| 3,287,034 | A * | 11/1966 | Bragg | 285/115 |
| 3,747,963 | A * | 7/1973 | Shivak | 285/336 |
| 4,615,544 | A * | 10/1986 | Baugh | 285/18 |
| 5,025,864 | A * | 6/1991 | Nobileau | 166/348 |
| 5,080,173 | A * | 1/1992 | Brammer | 166/348 |
| 5,555,935 | A * | 9/1996 | Brammer et al. | 166/88.1 |
| 6,668,919 | B2 * | 12/2003 | Radi | 166/208 |
| 8,245,776 | B2 * | 8/2012 | Gette et al. | 166/195 |
| 2007/0013146 | A1 * | 1/2007 | Gariepy | 277/608 |
| 2011/0308793 | A1 * | 12/2011 | Fenton | 166/250.08 |
| 2012/0006555 | A1 * | 1/2012 | Fraser et al. | 166/343 |
| 2012/0006557 | A1 * | 1/2012 | Fraser et al. | 166/350 |

FOREIGN PATENT DOCUMENTS

WO WO 02/38913 A1 5/2002

OTHER PUBLICATIONS

Dr. Michael Gooch, GB Search Report, Aug. 24, 2011.

* cited by examiner

*Primary Examiner* — Vishal Patel
*Assistant Examiner* — Nicholas L Foster
(74) *Attorney, Agent, or Firm* — Bracewell & Giuliani LLP

(57) ABSTRACT

A wellhead seal assembly that forms a metal-to-metal seal between inner and outer wellhead members and a face seal between inner wellhead members. The face seal is created by two opposing sealing surfaces on inner wellhead members that sealingly engage each other. The inner wellhead members that interact to form a face seal may be a casing hanger, bridging hanger, or lockdown hanger. A wicker profile formed on one of the opposing seal surfaces bites into the opposing seal surface in response to a load. The face seal is designed such that well pressure enhances the face seal.

22 Claims, 8 Drawing Sheets

WICKER-TYPE FACE SEAL AND WELLHEAD SYSTEM INCORPORATING SAME

FIELD OF THE INVENTION

This invention relates in general to wellhead assemblies and in particular to a seal for sealing between wellhead members.

BACKGROUND OF THE INVENTION

Seals are used between inner and outer wellhead members to contain internal well pressure. The inner wellhead member may be a casing hanger located in a wellhead housing that supports a string of casing extending into the well. Alternatively, the inner wellhead member could be a tubing hanger that supports a string of tubing extending into the well for the flow of production fluid. The tubing hanger lands in an outer wellhead member, which may be a wellhead housing, a Christmas tree, or a tubing head. A packoff or seal, seals between the inner wellhead member and the outer wellhead member. In addition, emergency annulus seals can be used in case the packoff seal fails.

However, sometimes all of these seals fail to maintain pressure integrity and contingency sealing measures must be taken. Bridging hangers are typically used as a contingency sealing option when both primary and emergency annulus seals have failed to maintain pressure integrity. A bridging hanger may replace the faulty seal with two separate seals, one to the hanger below and another to the housing. An elastomeric face seal may be used to form the seal between the bridging hanger and the casing hanger below. The elastomeric seal may degrade, or become damaged, thus compromising the seal that the contingency option needed to provide. This same problem may occur between lockdown hangers sealing to a hanger below and in addition may require the use of a long isolation sleeve extending to the hanger below when such is required.

A need exists for a technique that addresses the failures of contingency seals, increases the robustness of contingency sealing options, and minimizes isolation sleeve length requirements when lockdown hangers are employed. The following techniques may solve one or more of the problems provided above.

SUMMARY OF THE INVENTION

In an embodiment of the present technique, a seal assembly is provided that comprises: an annular seal located in a pocket defined by a wellhead bore and the exterior portion of an inner wellhead member such as a bridging hanger, and a face seal formed by opposing sealing surfaces on a bridging hanger and casing hanger. In this embodiment, a wicker profile is preferably formed onto the downward facing sealing surface that bites into the opposing seal surface. The wicker profile may be hardened. These features provide robustness in maintaining the integrity of the face seal. Backup seals may also be located within recesses formed on the downward facing sealing surface.

The face seal works in a similar fashion to the radially energized metal-to-metal seal but is instead axially energized. In the case of a bridging hanger, landing string weight or load from setting the annulus seal will create a sufficient load to force the wicker profile to "bite" into the softer material of the face seal such as low carbon steel or a binary alloy. Elastomeric seals may also be employed as back-up seals that will effectively have no extrusion gap due to the preload of the interface from the annulus seal.

When used on a bridging hanger, the face seal is pressured enhanced due to the net downward load on the bridging hanger. With pressure from below, the angled surface of the top of the hanger could act to increase contact forces as well, making the seal pressure enhanced from both directions.

This face seal design may also be used for a sealing lockdown hanger, in which case a lock ring on the lockdown hanger creates a sufficient load to force the wicker profile to bite into the opposing sealing surface to form a face seal. Further, the hanger can be sized so that the isolation sleeve seals into a bore larger than the inner diameter face wicker, allowing the face seal to be pressure enhanced in the primary direction as well. A wicker-type face seal on a sealing lockdown hanger will allow the isolation sleeve to tie directly into the lockdown hanger, significantly shortening the isolation sleeve and in turn the guide funnel and tree height. Tying into the lockdown hanger also allows for standardization on the short isolation sleeve instead of having to create custom solutions specific for each project.

This use of field proven wicker technology to form improved face seals between wellhead members maintains production integrity and provides a robust metal-to-metal seal for contingency and production use. In addition, the use of the improved face seal on lockdown hangers will lower the time and cost involved in isolation sleeve installations due to the shorter length and standardization of the isolation sleeve.

DETAILED DESCRIPTION OF THE INVENTION

Figure 1:
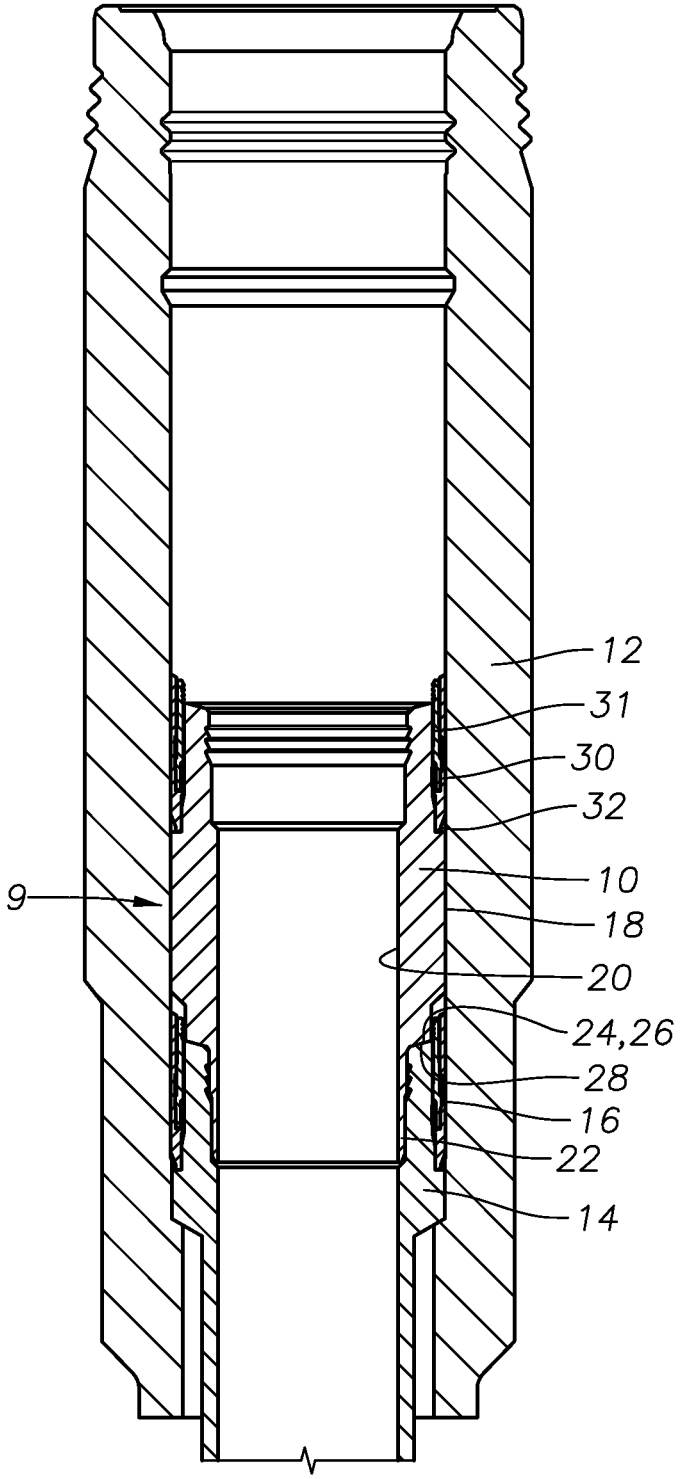
FIG. 1 is a sectional view of a wellhead assembly with a seal assembly in the set position, in accordance with an embodiment of the invention.

Referring to FIG. 1, an embodiment of the invention shows a portion of a seal assembly 9 located between an outer wellhead 12 and an inner wellhead member 10. In the illustrated embodiment, the outer wellhead 12 is a high pressure housing. The inner wellhead member 10 may be a bridging hanger that is landed on an existing casing hanger 14. However, it may be a second casing hanger landed on an existing casing hanger in a stacked arrangement. Typically, the bridging hanger 10 is landed on the casing hanger 14 when an annular seal 16, located between the wellhead 12 and the casing hanger 14, has failed. The bridging hanger 10 has an exterior cylindrical surface 18 and an interior profile 20. When landed, a lower portion 22 of the bridging hanger 14 internally extends into a corresponding profile formed in the casing hanger 14 interior.

Figure 2:
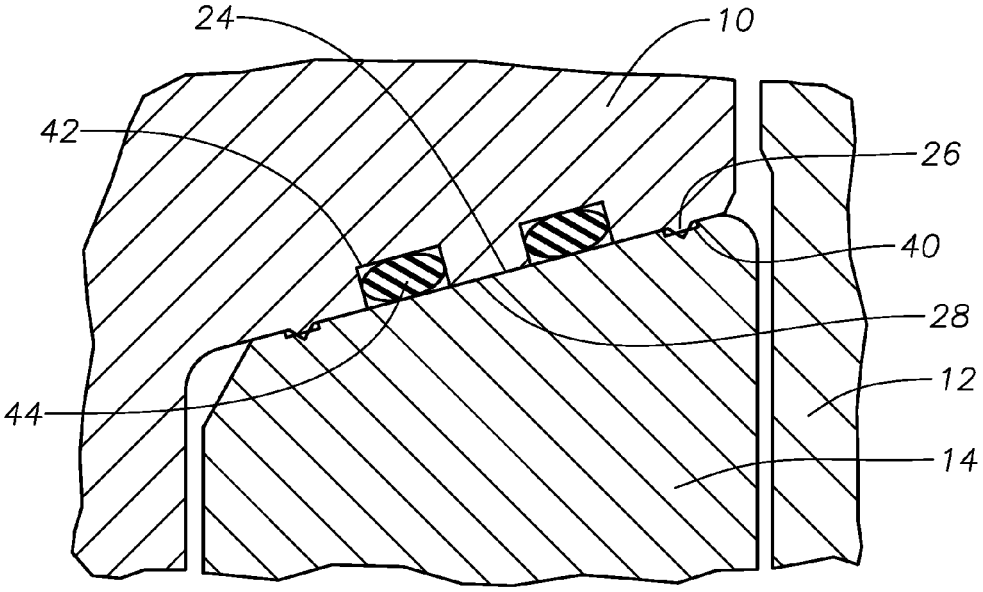
FIG. 2 is an enlarged sectional view of the face seal of the seal assembly in FIG. 1, in accordance with an embodiment of the invention.

Continuing to refer to FIG. 1, face sealing surfaces 24, 28, form a face seal as they sealingly engage each other when axially energized. As shown in FIG. 2, seal surface 24 formed on the casing hanger 14 faces upward and slants radially inward while opposing seal surface 28 formed on the bridging hanger 10 faces downward and also slants radially inward. In this example, the face seal formed is pressure enhanced due to the net downward load on the bridging hanger 10; pressure from below also enhances the face seal due to the slanted sealing surfaces 24, 28. Also, in this example, a wicker profile 26 may be formed on the downward facing seal surface 28. The wickers 26 are not threads, but a series of small triangular-shaped, parallel grooves and ridges on the sealing surface. The wickers may have a depth ranging from 1/16" to 1/8" and are formed from metal that can bite into the upward facing seal surface 24 to form a metal-to-metal seal that is a better seal than a smooth surface or elastomeric face seal. Energization of the face sealing surfaces 24, 28 may occur in response to, for example, hydraulic power, string weight, or torque, with the wicker profile 26 biting into the opposing seal surface 24. A soft material inlay 40 may be formed on the upward facing seal surface 24 that is deformed by the wicker profile 26 during setting. In this example, backup face seals 44 may be located within annular recesses 42 formed on the downward facing seal surface 28 of the bridging hanger 10. The backup face seals 44 may be fabricated from soft metal O-rings or an elastomer. If seals 44 are not used, wicker profile 4026 may then extend across surface 28. With seals 44, wickers 26 are only inward of seal 44 and outward of seal 44.

Figure 3:
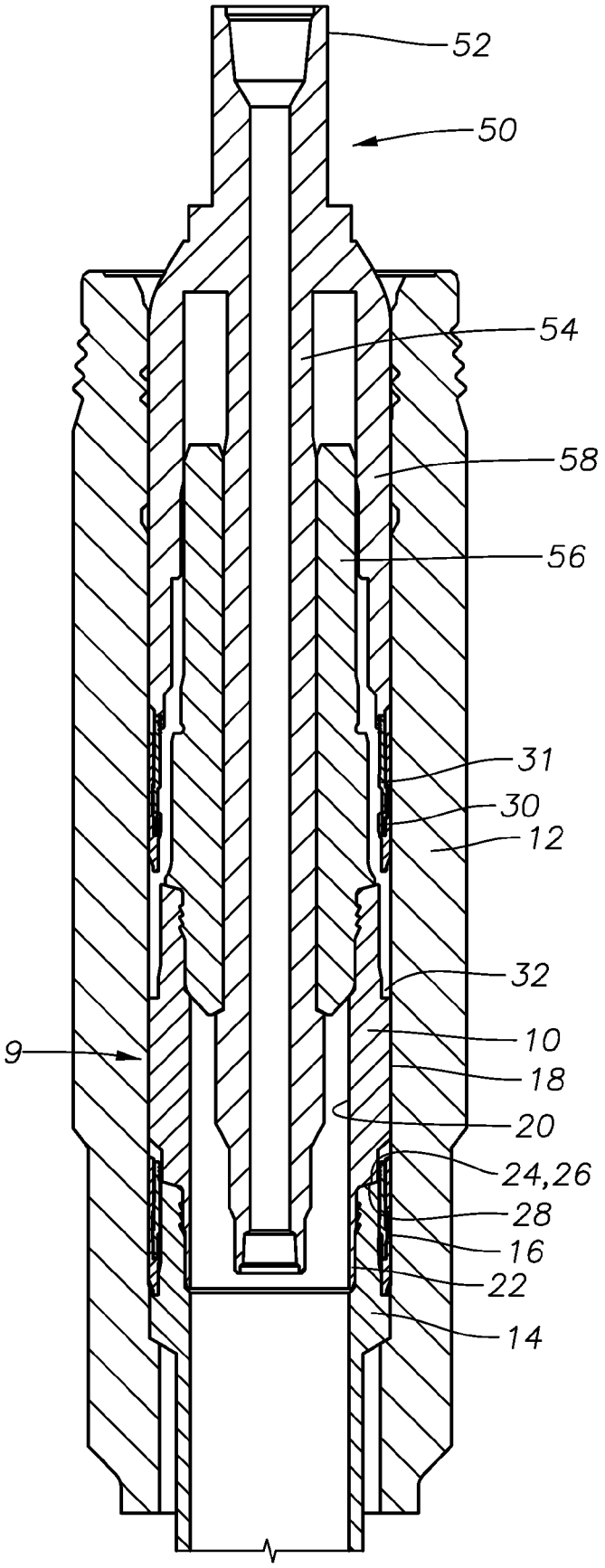
FIG. 3 is a sectional view illustrating a sequence of a running operation for the seal assembly, in accordance with an embodiment of the invention.

Referring to FIG. 3, an annular seal 30 may be set by force applied to an energizing ring 31. The energizing ring, in this example, forces apart leg tips of a pair of legs that form the annular seal 30. The annular seal 30 is set in a pocket 32 defined by the bore of the wellhead and the neck of the bridging hanger 10 and has outer surfaces that create a metal-to-metal seal with the bore of the wellhead and the outer surface of the bridging hanger 10 when set. The annular seal 30 can be bi-metallic with a lower yield metal forming the areas of sealing contact, such as the tips of the legs forming the annular seal 30.

Figure 4:
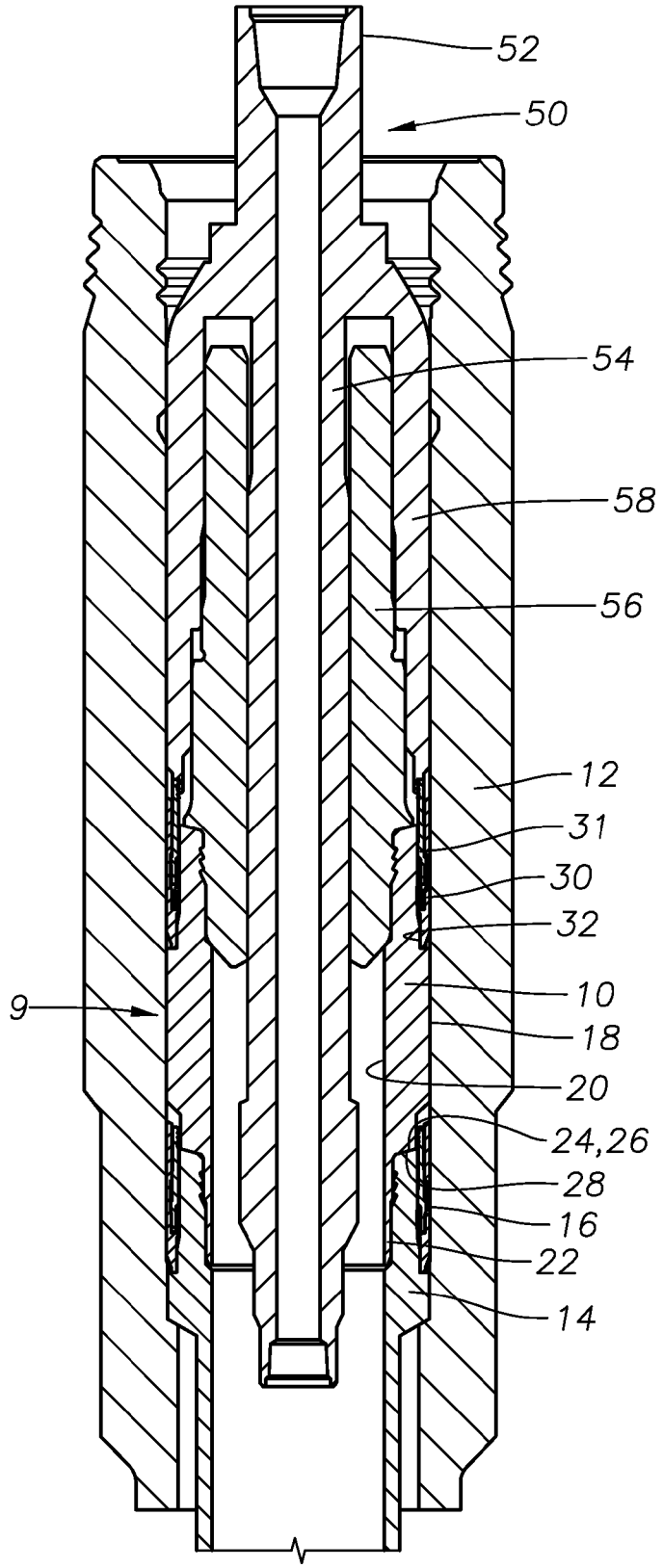
FIG. 4 is a sectional view illustrating a subsequent sequence of a running operation for the seal assembly, in accordance with an embodiment of the invention.
Figure 5:
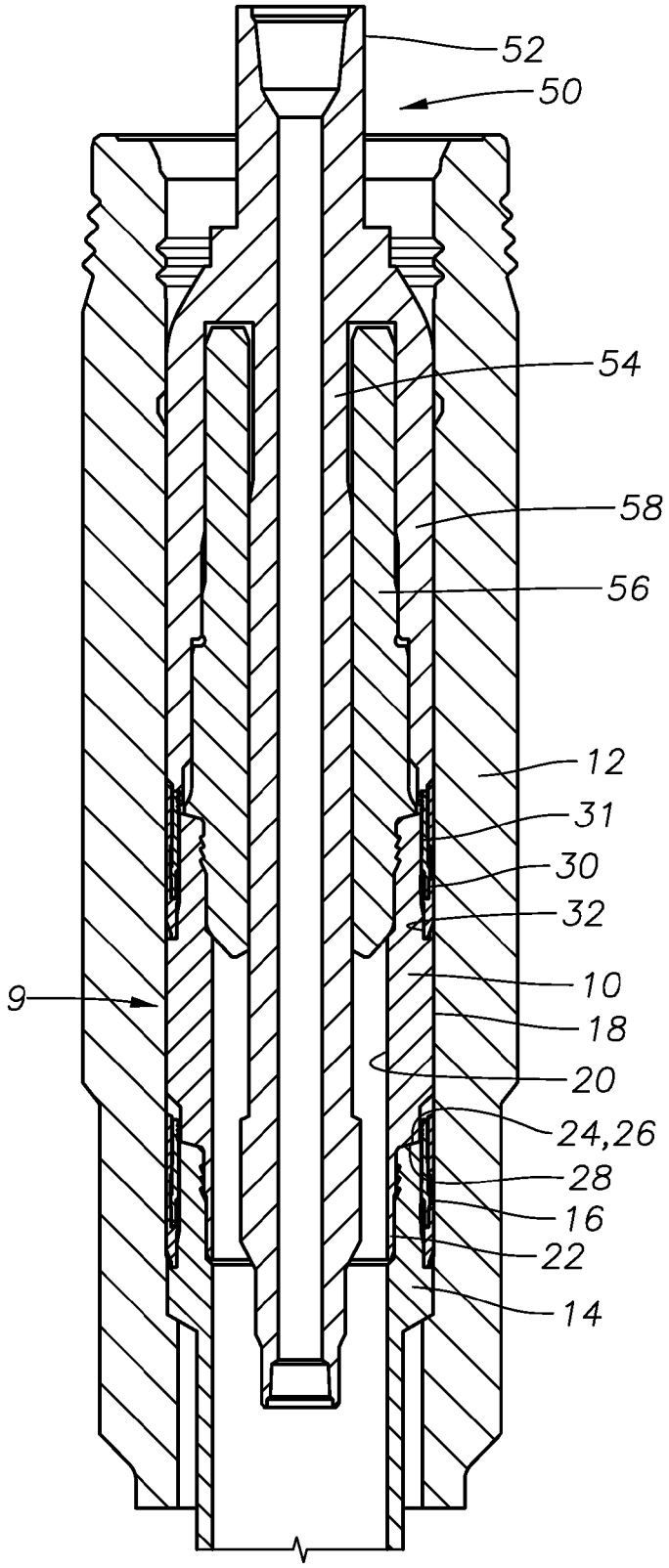
FIG. 5 is a sectional view illustrating a further sequence of a running operation for the seal assembly, in accordance with an embodiment of the invention.

During the running operation, as shown in FIGS. 3 to 5, the bridging hanger 10 and annulus seal 30 are attached to a running tool 50 at the rig surface. The running tool 50 has a neck 52 for connecting to a drill string (not shown), an internal body 56 and an external body 58. The bridging hanger 10 in this example is connected to the internal body 56 of the running tool 50 while the annulus seal 30, including the energizing ring 31, is carried by the external body 58 of the running tool 50. The running tool 50 lowers the bridging hanger 10 and the annulus seal 30 down the well until the downward facing seal surface 28 of the bridging hanger 10 lands on the upward facing seal surface 24 of the casing hanger 14 below it. Because, the annulus seal 16 on the casing hanger 14 has failed to hold pressure, the bridging hanger 10 is necessary to seal off communication to the annulus below the casing hanger 14.

When the bridging hanger 10 is landed on the casing hanger 14, additional force exerted on the running tool 50 causes the external body 58 to axially slide relative to the internal body 56 of the running tool 50. As shown in FIG. 4, this action delivers the annulus seal 30 to the pocket 32 defined by the bore of the wellhead 12 and an exterior portion of the bridging hanger 10. In this example, the force required to push the annulus seal 30 into the pocket 32 will also fully make up the face seal of the bridging hanger 10 by forcing the wicker profile 26 formed on the downward facing seal surface 28 of the bridging hanger to bite into the opposing, upward facing seal surface 24 on the casing hanger 14. Both the seal surfaces 24, 28 forming the face seal and the annulus seal 30 are necessary to perform the duty that the annulus seal 16 below failed to perform.

The upward facing surface 24 of the casing hanger 14 may be formed of a softer metal than that of the wicker profile 26 or wickers 26 may contain an inlay of soft metal. Further, the wicker profile 26 may be formed from a different type of metal that is harder than that of the rest of the upward facing surface 24, such as Inconel® 725. The yield strength of carbon steel casing hanger 14 is approximately 55 to 110 ksi, depending on the application. The wickers may have 120 ksi minimum yield strength and a hardness can vary between roughly less than 20 Rockwell C ("HRC") to greater than roughly 37 HRC. The higher hardness of the wickers 26 on the downward facing surface 28 ensures biting into the upward facing surface 24.

Further downward force from the running tool 50, as shown in FIG. 5, will completely set the annulus seal 30 by driving the energizing ring 31 between the legs of the annulus seal 30 to force the legs outward and into sealing engagement with bore of the wellhead 12 and neck of the bridging hanger 10. The running tool 50 can then be unlocked and retrieved to the surface.

Figure 6:
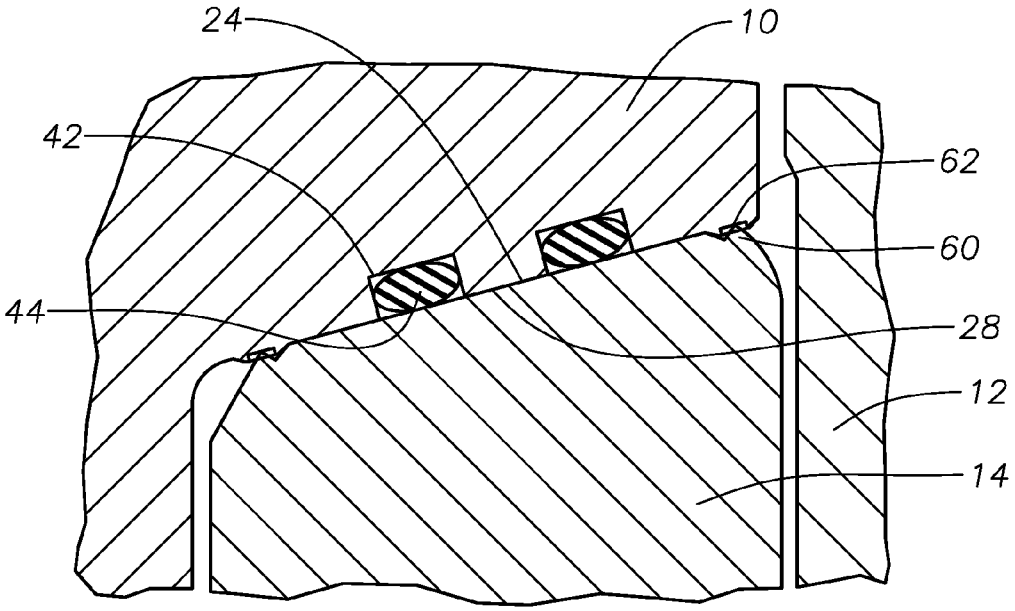
FIG. 6 is a sectional view of a seal assembly with a wicker profile formed on an upward facing surface, in accordance with an embodiment of the invention.

In an additional embodiment illustrated in FIG. 6, a wicker profile 60 is formed on the upward facing seal surface 24 of the casing hanger 14. A soft inlay material 62 may be formed on the downward facing seal surface 28 of the bridging hanger 10. The wicker profile 60 deforms the soft inlay 62 when the seal surfaces 24, 28 sealingly engage to form a face seal between the bridging hanger 10 and the casing hanger 14. Backup seals 44 may optionally be used. If backup seals 44 are used then wicker 60 are located inward and outward of the backup seals 44. If no backup seals are used, the wicker profile 60 extends across surface as in FIG. 7.

Figure 11:
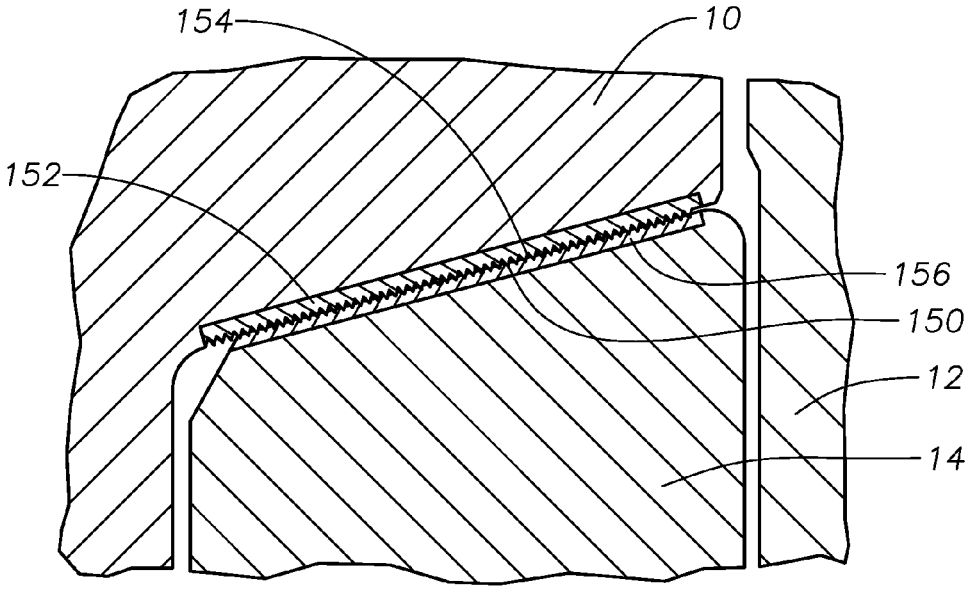
FIG. 11 is a sectional view of a seal assembly with a wicker profile comprising a plurality of teeth formed on a hardened downward facing surface and a soft inlay on upward facing surface, in accordance with an embodiment of the invention.
Figure 7:
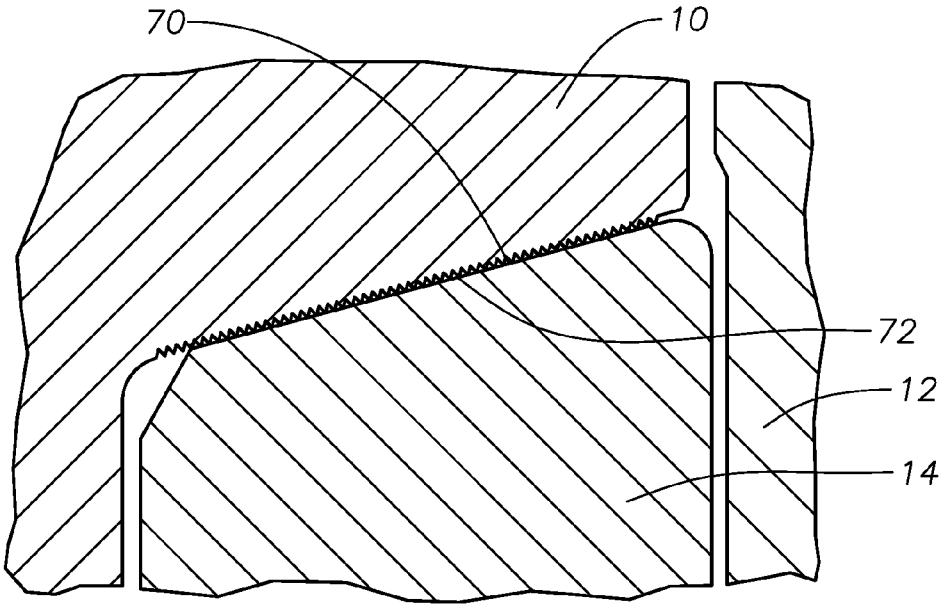
FIG. 7 is a sectional view of a seal assembly with a wicker profile comprising a plurality of teeth formed on a downward facing surface, in accordance with an embodiment of the invention.

In an additional embodiment illustrated in FIG. 7, a wicker profile comprises a plurality of teeth 72. The teeth 72 may be hardened to enhance the bite of the teeth onto the upward facing surface 70 of the casing hanger 14 during the establishment of the face seal between the bridging hanger 10 and the casing hanger 14. In FIG. 7, backup seals 42 are not employed. Wicker 72 extend substantially across full width of the shoulder on bridging hanger 10. As shown in FIG. 11, a hardened metal layer 150 may also be formed on one of the seal surfaces with the wicker profile 152 formed onto the hard metal. The seal surface 154 opposite the hardened wickers 152 may also be a soft inlay 156 that is deformed by the wicker profile 152.

Figure 8:
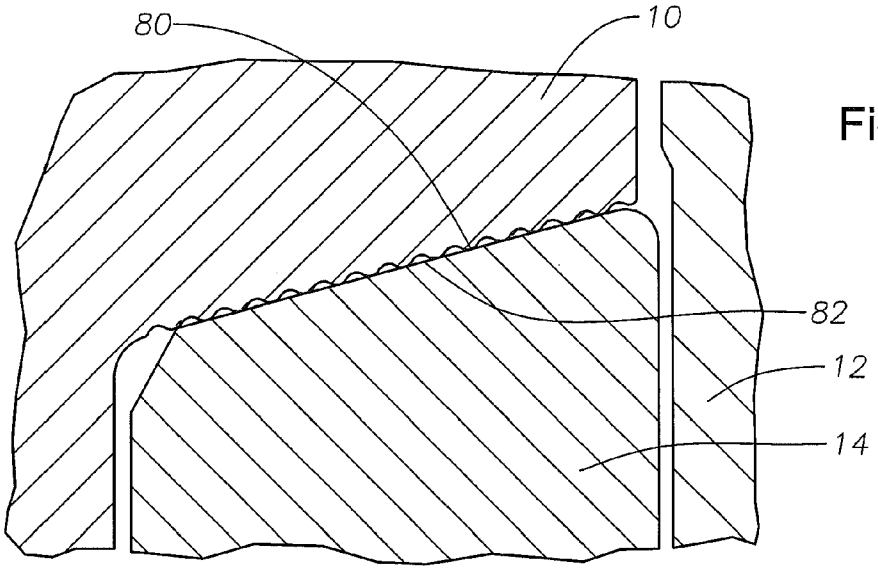
FIG. 8 is a sectional view of a seal assembly with a wicker profile comprising a a plurality of wave-shapes formed on a downward facing surface, in accordance with an embodiment of the invention.
Figure 8A:
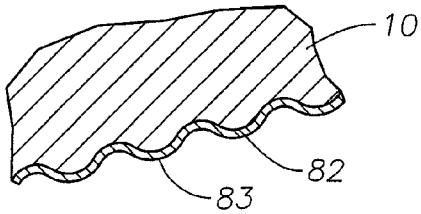
FIG. 8*a* is an enlarged sectional view of a portion of the seal assembly in FIG. 8, schematically illustrating a coating.

In an additional embodiment illustrated in FIG. 8, a wicker profile comprises a wave-shaped downward facing seal surface 82 on the bridging hanger 10. As schematically illustrated in FIG. 8*a* the wave feature may be coated with a soft metal 81 such as silver or tin to effect a gas tight seal when the downward facing seal surface 82 sealingly engages the upward facing seal surface 80 of the casing hanger 14 to thereby create a face seal. The configuration is generally sinusoidal.

Figure 9:
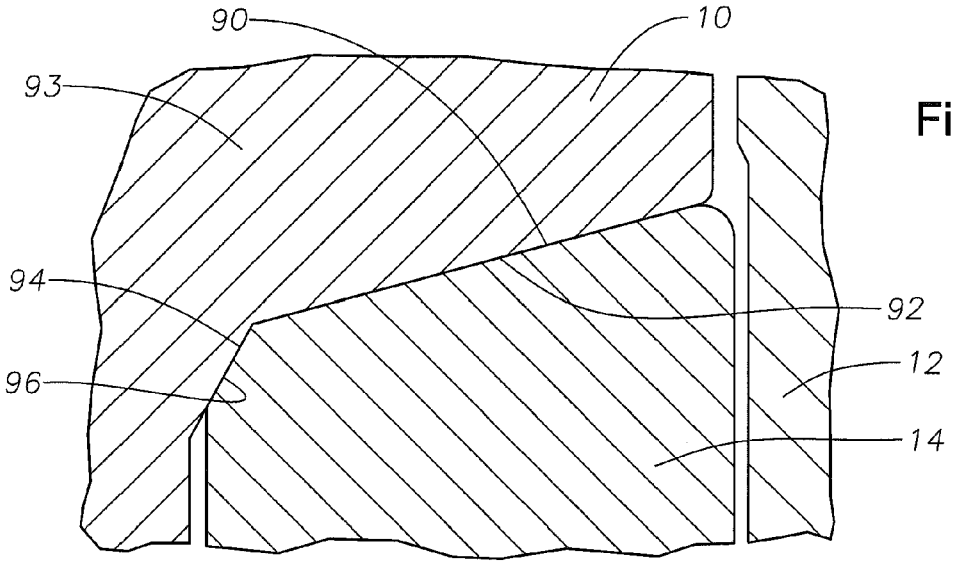
FIG. 9 is a sectional view of a seal assembly with a tapered seal surface, in accordance with an embodiment of the invention.

In an additional embodiment illustrated in FIG. 9, an upward facing outer seal surface 90 on the casing hanger 14 sealingly engages the downward facing seal surface 92 of the bridging hanger 10. Additionally, a conical inner seal surface 96 formed on the bridging hanger 10 sealingly engages an opposing conical inner seal surface 94 on the casing hanger 14. These conical surfaces together form a face seal between the bridging hanger 10 and the casing hanger 14. Seal surface 92 is at an intersection between surface 92 and the cylindrical neck 93 of bridging hanger 10. Seal surface 92 is at intersection between surface 90 and cylindrical bore of casing hanger 14. The angle may vary and in this example is about 30 to 45 degrees relative to vertical.

Figure 10:
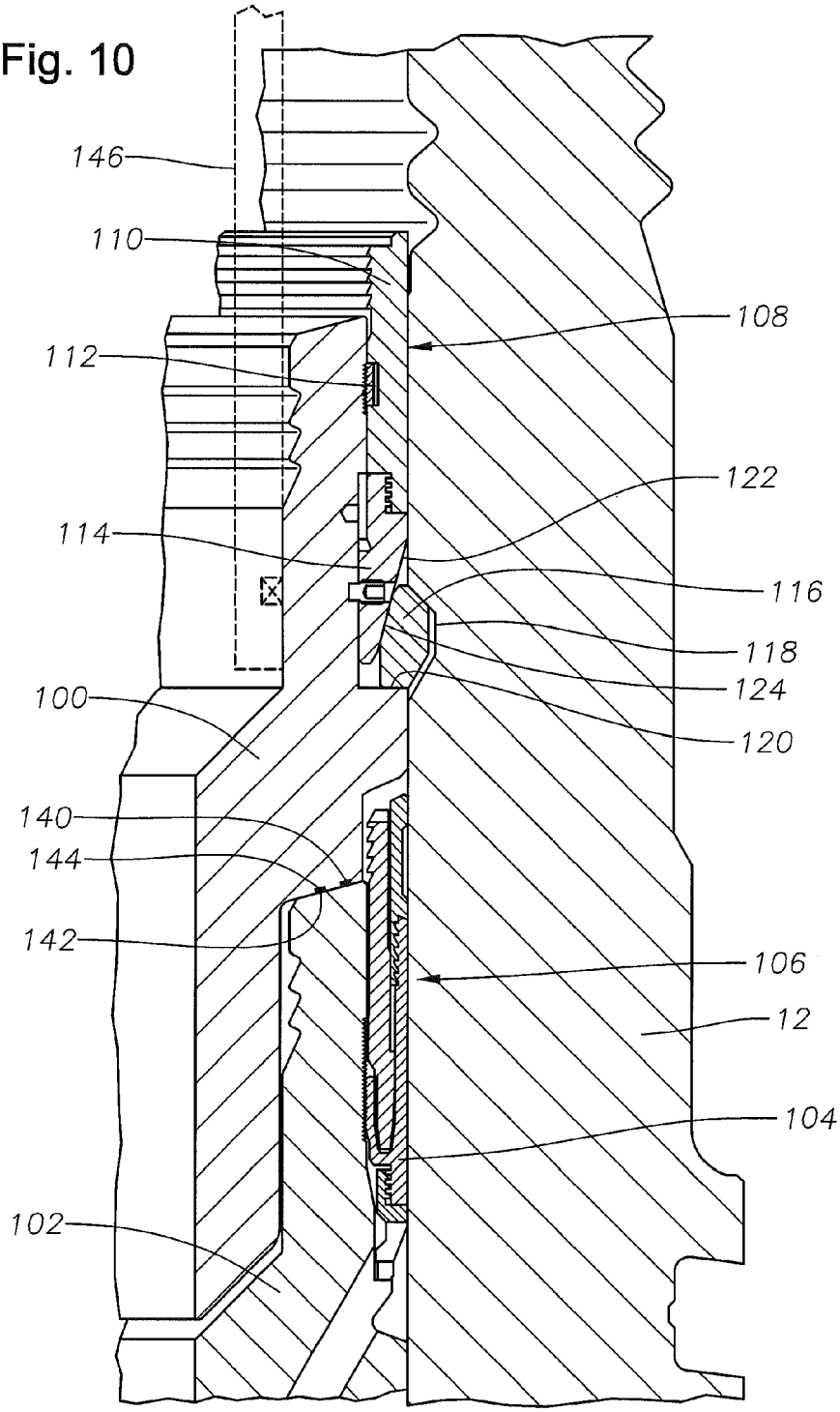
FIG. 10 is a sectional view of a seal assembly with a lockdown hanger, in accordance with an embodiment of the invention.

In an additional embodiment illustrated in FIG. 10, a face seal as described above can also be created between a lockdown hanger 100 and lower hanger 102, such as a casing hanger. The lockdown hanger 100 is typically installed at the very top of a stack of hangers found in the wellhead 12 and functions to resist upward movement and forces due to pressure from below the stack of hangers as well as thermal growth of the casing strings. Lockdown hangers typically do not seal to the casing hanger 102 below them and do not support a string of casing. An annular seal 106 seals the annulus between the casing hanger 102 and the wellhead 12 and does not interact with the lockdown hanger 100 above. A face seal, in this embodiment, is established by an upward facing seal surface 144 on the casing hanger 102 sealingly engaging a downward facing seal surface 142 on the lockdown hanger 100. A wicker profile 140 like those described above may be incorporated into the face seal. In addition, a backup face seal 44 (FIG. 2) such as that described above may also be utilized.

When the lockdown hanger 100 is set, it is maintained in place by a conventional locking assembly 108 comprising a nut 110, a ratchet ring 112, and an activating member 114 having a tapered surface 122. The activating member 114 forces an inwardly biased lock ring or C-ring 116 into a profile 118 formed on the bore of the wellhead housing 12. The lock ring 116 is supported from below by an upward facing shoulder 120 formed on the lockdown hanger 100.

During a running operation for the lockdown hanger 100, the lockdown hanger 100, the locking assembly 108, and the unexpanded lock ring 116, are assembled onto a running tool (not shown) at the surface and are lowered into the well until the downward facing seal surface 142 comes into contact with the upward facing seal surface 144. Initially, the activating member 114 is in the up position and may be kept in place by, for example, shear pins.

The lockdown hanger 100 running tool then applies an axial load to the top of the activating member 114, shearing the pins and driving it down. The ratchet ring 112 prevents the activation member 14 from moving back up. The force in turn causes the lock ring 116, supported by the shoulder 120, to expand radially outwards as it slides along the tapered surface 124 of the activating member 114. The lock ring 116 is expanded until it comes in contact with the profile 118 on the bore of the wellhead housing 12.

Further downward force on the activating member 114 generates preload as the lock ring 116 is compressed between the profile 118 and the upward facing shoulder 120 of the lockdown hanger 100. This compressive force is transmitted down through the lockdown hanger 100 body into the hanger 102 below, thus preloading the face seal interface formed by the opposing seal surfaces 144, 142.

By establishing a face seal between the opposing seal surfaces 144, 142, pressure integrity is transferred up closer to the top of the wellhead 12, allowing an isolation sleeve 146 (net shown by dotted lines) or a christmas tree (not shown) to tie directly into the lockdown hanger 100 rather than having to protrude further down the wellhead bore to reach the casing hanger 102 located below. The isolation sleeve 146 will thus create a radial seal to the bore of the lockdown hanger 100 at an axial position that is approximately at midway point of the activating member 114. In a non-sealing lockdown hanger, the portion of the lockdown hanger body that protrudes into the bore of the hanger below it would not be present and thus the isolation sleeve would have to form a radial seal to the bore of the hanger below the lockdown hanger directly adjacent to the annulus seal 106. Note that this sealing position is much lower in the wellhead assembly than the sealing position provided by a lockdown hanger with a face seal.

In lockdown hanger applications, a shorter isolation sleeve has numerous advantages since less alignment is required to install the christmas tree, thereby reducing the cost of both the christmas tree and any alignment guide funnels necessary for installation. In all applications of the invention, the main advantage of using this type of wicker enhanced face seal over traditional radial seals is the positive bite or interference possible with a face seal. This not only forms a better gas tight seal but also is more resistant to scratches and debris that are ubiquitous in drilling environments. Also, since the face seal creates a seal that is further outboard than what is possible with a radial seal, which is typically formed on the inner diameter of the hanger, the face seal is more resistant to high pressures in the annulus since pressure below the casing hanger 14 acts to further compress the face seal interface, forming an even tighter seal via pressure energization. Further, a face seal does not restrict the "drift diameter" of the casing hanger 14 below it, allowing larger drill bit diameters to be used for subsequent drilling operations.

While the invention has been shown in only selected forms, it should be apparent to those skilled in the art that it is not so limited but is susceptible to various changes without departing from the scope of the invention. For example, the packoffs with inner and outer legs that are wedged apart by an energizing ring may be replaced by other types of packoffs.

What is claimed is:

1. A wellhead assembly with an axis, comprising:

an outer wellhead member having a bore;

a casing hanger located in the bore with a rim on an upper end having an upward facing seal surface, the casing hanger having an interior profile and a lower end for securing to a string of casing;

a casing hanger packoff that seals between an outer diameter portion of the casing hanger and the bore of the outer wellhead member;

an upper hanger located in the bore and having a downward facing shoulder that lands on the rim and has a downward facing seal surface that seals against the upward facing seal surface, the upper hanger having an interior profile in fluid communication with the interior profile of the casing hanger and a lower end free of attachment to any string of casing;

a wicker profile formed on one of the seal surfaces, the wicker profile comprising concentric grooves with crests that are embedded into the other seal surface when the upper hanger is set into place; and an annular member encircling an outer wall of the upper hanger and wedged between the upper hanger and the bore of the outer wellhead member, the annular member resisting any upward movement of the upper hanger relative to the casing hanger after the upper hanger is set.

2. The assembly according to claim 1, wherein the wicker profile is formed into the downward facing seal surface of the upper hanger.

3. The assembly according to claim 1, wherein the wicker profile is formed into the upward facing seal surface of the casing hanger.

4. The assembly according to claim 1, wherein the wicker profile is formed into a hard metal layer located on one of the seal surfaces, the hard metal layer being harder than the other of the seal surfaces.

5. The assembly according to claim 1, further comprising a soft inlay formed on one of the upward or downward facing seal surfaces that is deformed by the wicker profile when set.

6. The assembly according to claim 1, wherein the wicker profile has a generally sinusoidal shape, with the crests and the grooves being rounded and coated with a soft metal.

7. The assembly according to claim 1, wherein:

the bore of the outer wellhead member has an annular lockdown groove;

the upper hanger comprises a lockdown hanger with a lower end not connected to any string of casing after the lockdown hanger is set;

the annular member comprises a lockdown ring carried by the lockdown hanger and being radially expansible into engagement with the lockdown groove; and the assembly further comprises:

a christmas tree isolation sleeve having a lower end that sealingly engages the interior profile of the lockdown hanger.

8. The assembly according to claim 1, wherein:

the upper hanger comprises a bridging hanger employable in the event the casing hanger packoff seal between the casing hanger and the bore fails, the bridging hanger having a lower end not connected to any string of casing after the bridging hanger is set; and the annular member comprises a bridging hanger packoff seal that seals between the bridging hanger and the bore of the outer wellhead member.

9. A wellhead assembly with an axis, comprising:

an outer wellhead member having a bore;

a first inner wellhead member located in the bore with a rim on an upper end having an upward facing seal surface;

a second inner wellhead member located in the bore and having a downward facing shoulder that lands on the rim and has a downward facing seal surface that seals against the upward facing seal surface;

a wicker profile formed on one of the seal surfaces that is embedded into the other seal surface when the second inner wellhead member is set into place; and a backup face seal located within a recess formed on the downward facing seal surface of the second inner wellhead member; and wherein the wicker profile comprises an inner wicker profile located inward of the backup face seal and an outer wicker profile located outward of the backup face seal.

10. The assembly according to claim 9, wherein the backup face seal is one of the following:

a. a metallic ring; or b. an elastomeric seal.

11. A wellhead assembly with an axis, comprising:

an outer wellhead member having a bore;

a casing hanger for securing to a string of casing, the casing hanger being located in the bore and having a rim on an upper end having an upward facing seal surface, the casing hanger having an interior profile;

an upper hanger secured to the outer wellhead member in the bore and having a downward facing shoulder that lands on the rim and has a downward facing seal surface, the upper hanger having a neck spaced radially inward from the bore of the outer wellhead member, defining an annular pocket, the upper hanger having an interior profile in fluid communication with the interior profile of the casing hanger;

a casing hanger packoff seal located between an outer wall of the casing hanger and the bore of the outer wellhead member, and a wicker profile comprising circular concentric grooves with crests formed on the downward facing seal surface, the wicker profile being harder than the upward facing seal surface and embedded into the upward facing seal surface when the upper hanger is set into place; and an annular member in the pocket wedged between the neck and the bore of the outer wellhead member, the annular member resisting upward movement of the upper hanger relative to the casing hanger after the upper hanger has been set in place.

12. The assembly according to claim 11, wherein;

the upper hanger has a lower tubular extension that extends downward from the downward facing shoulder into the interior profile of the casing hanger;

the downward facing seal surface extends continuously substantially from an outer diameter potion of the upper hanger to the lower tubular extension of the upper hanger; and the wicker profile extends continuously across an entire width of the downward facing seal surface.

13. The assembly according to claim 11, wherein the wicker profile comprises an inner wicker profile spaced radially from an outer wicker profile; and the assembly further comprises a seal located within a groove formed in the downward facing seal surface between the inner and outer wicker profiles.

14. The assembly according to claim 11, wherein the wicker profile is formed in a hard metal layer located on the downward facing shoulder, the hard metal layer having a greater hardness than a hardness of the upper hanger.

15. The assembly according to claim 11, further comprising a soft metal inlay formed on the upward facing seal surface that is deformed by the wicker profile when set.

16. The assembly according to claim 11, wherein the wicker profile has a generally sinusoidal shape with the crests and the grooves being rounded and coated with a soft metal.

17. The assembly according to claim 11, wherein:

the bore of the outer wellhead member has an annular lockdown groove;

the upper hanger comprises a lockdown hanger with a lower end not connected to any string of casing when the upper hanger is set; and the annular member comprises a lockdown ring carried by the upper hanger and being radially expansible into engagement with the lockdown groove.

18. The assembly according to claim 11, wherein:

the upper hanger comprises a bridging hanger that is employed in the event the casing hanger packoff seal between the casing hanger and the bore fails, the bridging hanger having a lower end not connected to any string of casing; and the annular member comprises a bridging hanger packoff seal that seals between the neck of the bridging hanger and the bore of the outer wellhead member.

19. The assembly according to claim 17, further comprising:

a christmas tree isolation sleeve having a lower end that sealingly engages the interior profile of the lockdown hanger.

20. A method for sealing between wellhead members, comprising:

installing an outer wellhead member having a bore;

providing a casing hanger with a rim having an upward facing seal surface, an upper hanger with a downward facing shoulder having a downward facing seal surface, each of the casing hanger and the upper hanger having an interior profile, the interior profiles being in fluid communication with each other, and a wicker profile comprising concentric circular grooves with crests on one of the seal surfaces;

securing the casing hanger to a string of casing and installing the casing hanger in the bore;

setting a casing hanger packoff seal between an outer wall of the casing hanger and the bore of the outer wellhead member;

running and landing the downward facing shoulder of the upper hanger on the rim;

embedding the crests of the wicker profile into the other seal surface when the upper hanger is set to seal the seal surfaces to each other; and wedging an annular member between the upper hanger and the bore of the outer wellhead member, thereby resisting any upward movement of the upper hanger relative to the casing hanger.

21. The method according to claim 20, wherein:

providing the upper hanger comprises providing a bridging hanger in the event the casing hanger packoff seal between the casing hanger and the bore fails, the bridging hanger having a lower end not connected to any string of casing; and wedging the annular member comprises wedging a bridging hanger packoff seal between the bridging hanger and the bore of the wellhead member to seal between the bridging hanger and bore of the outer wellhead member.

22. The method according to claim 20, further comprising:

providing the bore of the outer wellhead member with an annular lockdown groove; wherein the upper hanger comprises a lockdown hanger with a lower end not connected to any string of casing;

wedging the annular member comprises radially expanding a lockdown ring into engagement with the lockdown groove; and the method further comprises:

sealingly engaging a lower end of a christmas tree isolation sleeve into the interior profile of the lockdown hanger.

* * * * *